US008475105B2

(12) United States Patent
Coric et al.

(10) Patent No.: US 8,475,105 B2
(45) Date of Patent: Jul. 2, 2013

(54) BINDING SYSTEM WITH BINDING MACHINE AND BINDING ELEMENTS

(75) Inventors: Milos Coric, Lincolnshire, IL (US); Ezra Szoke, Inverness, IL (US); Colin G. Knight, Winnetka, IL (US)

(73) Assignee: ACCO Brands Corporation, Lake Zurich, IL (US)

( * ) Notice: Subject to any disclaimer, the term of this patent is extended or adjusted under 35 U.S.C. 154(b) by 136 days.

(21) Appl. No.: 12/842,125

(22) Filed: Jul. 23, 2010

(65) Prior Publication Data

US 2011/0020095 A1 Jan. 27, 2011

Related U.S. Application Data

(60) Provisional application No. 61/228,364, filed on Jul. 24, 2009.

(51) Int. Cl.

| | |
|---|---|
| ***B42C 13/00*** | (2006.01) |
| ***B42C 9/00*** | (2006.01) |
| ***B42C 5/08*** | (2006.01) |
| ***B42C 5/00*** | (2006.01) |
| ***B42B 5/06*** | (2006.01) |

(52) U.S. Cl.
USPC ..... 412/14; 412/1; 412/6; 412/7; 412/33; 412/34; 412/38; 412/39; 412/40

(58) Field of Classification Search
USPC ..... 412/1, 6, 7, 14, 33, 34, 38, 39, 40
See application file for complete search history.

(56) References Cited

U.S. PATENT DOCUMENTS

| | | | |
|---|---|---|---|
| 4,079,647 | A | 3/1978 | Elder et al. |
| D261,529 | S | 10/1981 | Hausmann |
| D261,530 | S | 10/1981 | Hausmann |
| 4,607,993 | A | 8/1986 | Scharer |
| 4,613,266 | A | 9/1986 | Scharer |
| 4,645,399 | A | 2/1987 | Scharer |
| D296,115 | S | 6/1988 | Scharer |
| 4,820,099 | A | 4/1989 | Battisti |
| 4,900,211 | A | 2/1990 | Vercillo |
| 4,902,183 | A | 2/1990 | Vercillo et al. |
| 5,051,050 | A | 9/1991 | Scharer |
| 5,090,859 | A | 2/1992 | Nanos et al. |
| D358,834 | S | 5/1995 | Cox |
| 5,419,668 | A | 5/1995 | Ballist |
| D359,065 | S | 6/1995 | Cox |
| 5,615,986 | A | 4/1997 | Cox |
| 5,669,747 | A | 9/1997 | Scharer |

(Continued)

FOREIGN PATENT DOCUMENTS

| | | |
|---|---|---|
| EP | 1741562 | 1/2007 |

OTHER PUBLICATIONS

International Search Report and Written Opinion in corresponding PCT/US2010/043072 dated Dec. 28, 2010, 9 pages.

*Primary Examiner* — Dana Ross
*Assistant Examiner* — Justin V Lewis
(74) *Attorney, Agent, or Firm* — Michael Best & Friedrich LLP

(57) ABSTRACT

A binding system for binding a stack of sheets with a binding element includes a binding machine having an indicia associated with an operation to be performed in binding the stack of sheets, and at least one binding element having an indicia corresponding to the indicia on the binding machine.

13 Claims, 6 Drawing Sheets

U.S. PATENT DOCUMENTS

| | | | | |
|---|---|---|---|---|
| 5,740,712 | A | 4/1998 | Watkins et al. | |
| 5,785,479 | A | 7/1998 | Battisti et al. | |
| 5,934,340 | A | 8/1999 | Anthony, III et al. | |
| 5,971,689 | A | 10/1999 | Scharer et al. | |
| D423,039 | S | 4/2000 | Cox | |
| 6,079,924 | A | 6/2000 | Chiang | |
| 6,527,016 | B2 | 3/2003 | Todaro | |
| 6,527,157 | B1 * | 3/2003 | Choi | 227/76 |
| D482,058 | S | 11/2003 | Knight | |
| D482,385 | S | 11/2003 | Knight | |
| D483,798 | S | 12/2003 | Knight | |
| 6,773,216 | B2 | 8/2004 | Crudo et al. | |
| D497,939 | S | 11/2004 | Henderson et al. | |
| D504,148 | S | 4/2005 | Smith et al. | |
| D507,808 | S | 7/2005 | Smith et al. | |
| 7,168,903 | B2 | 1/2007 | Hild | |
| D544,525 | S | 6/2007 | Beno et al. | |
| D550,759 | S | 9/2007 | Beno et al. | |
| 2006/0277967 | A1 * | 12/2006 | Ballas et al. | 72/416 |
| 2007/0041809 | A1 * | 2/2007 | Mintzer | 411/457 |
| 2007/0160445 | A1 * | 7/2007 | Aries et al. | 412/38 |
| 2008/0080958 | A1 * | 4/2008 | Henderson et al. | 412/14 |
| 2008/0128467 | A1 * | 6/2008 | Bhavnani | 40/358 |
| 2009/0129892 | A1 | 5/2009 | Okada | |

* cited by examiner

BINDING SYSTEM WITH BINDING MACHINE AND BINDING ELEMENTS

RELATED APPLICATIONS

This application claims the benefit of U.S. Provisional Patent Application No. 61/228,364 filed Jul. 24, 2009, the entire content of which is incorporated herein by reference.

BACKGROUND

The present invention relates to binding machines and binding elements used to bind stacks of sheets.

Binding machines for binding stacks of sheets are known. The machines include a punching mechanism for punching the stack of sheets to be bound, and a binding apparatus for binding the punched stack of sheets. Various types of binding elements can be used with the binding apparatus, including elements typically referred to as "comb" binding elements.

SUMMARY

Binding machine users are faced with many operational steps and decisions when attempting to bind a stack of sheets. The present invention includes a binding machine and binding element system having features that greatly facilitate the user's operational and decision-making process, thereby making operation of the binding machine intuitive and user-friendly.

More specifically, the invention provides a binding system for binding a stack of sheets with a binding element. The binding system includes a binding machine having an indicia associated with an operation to be performed in binding the stack of sheets, and at least one binding element having an indicia corresponding to the indicia on the binding machine.

The invention further provides a binding element for use in conjunction with a binding machine for binding a stack of sheets. The binding element includes a spine, a plurality of fingers coupled with the spine for forming ring elements operable to retain the stack of sheets, and an indicia on the binding element for associating with an indicia on a binding machine used for binding the stack of sheets.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
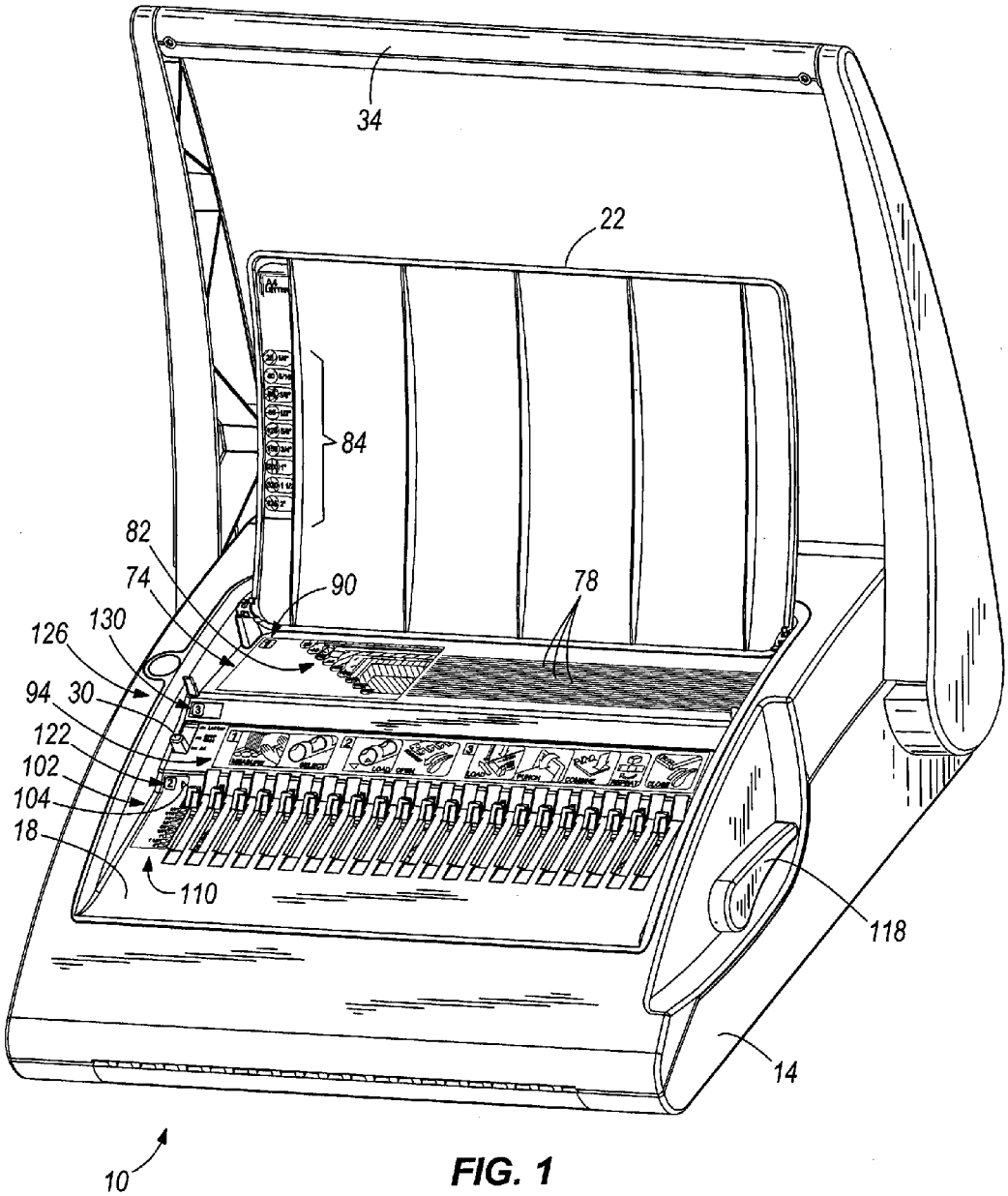
FIG. 1 is a perspective view of a binding machine embodying the invention.
Figure 2:
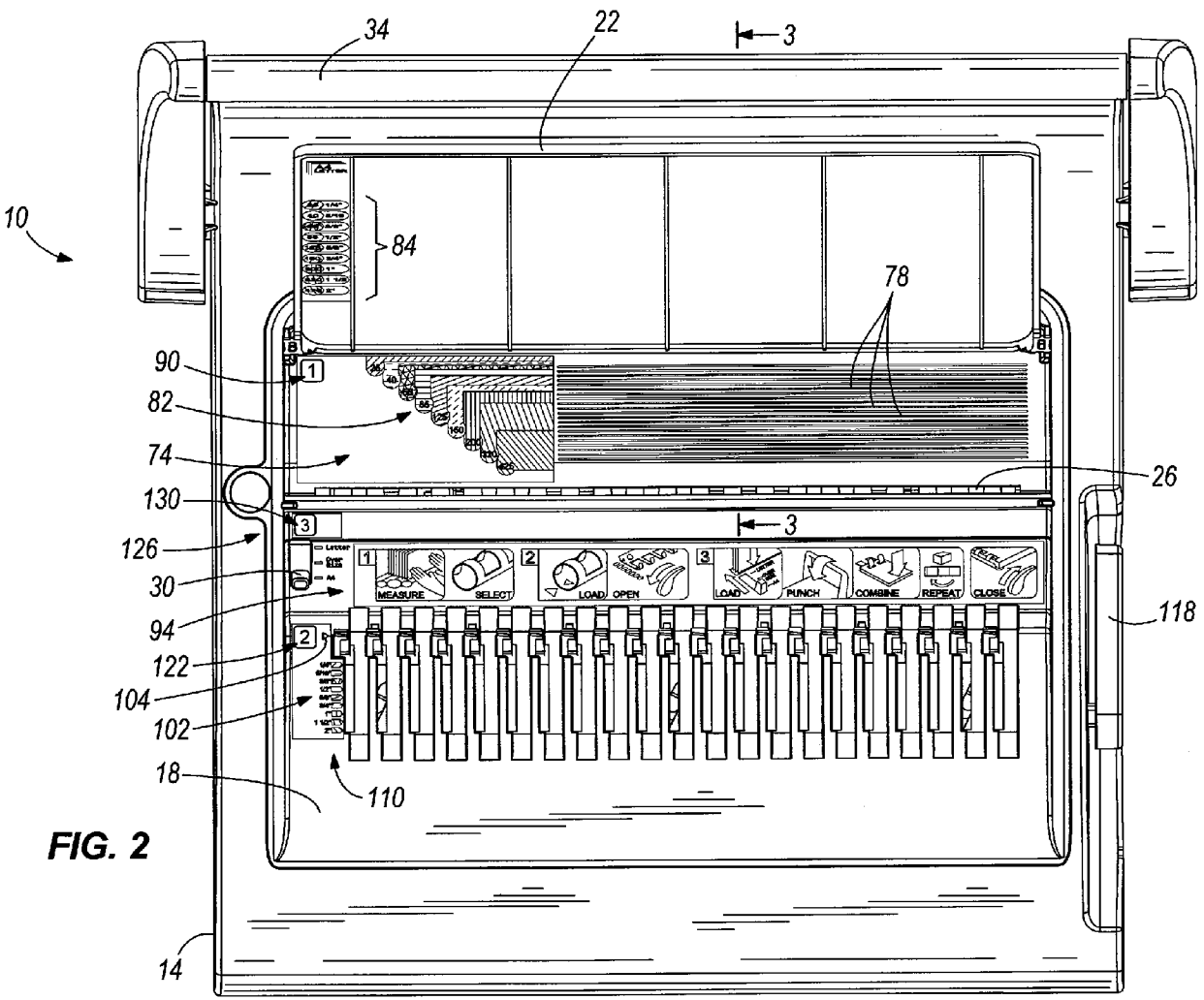
FIG. 2 is a top view of the binding machine of FIG. 1.

FIGS. 1 and 2 illustrate a binding machine 10 according to the present invention. The binding machine 10 includes a body 14 having thereon a working deck 18 where a user performs the various operations for binding a stack of sheets. A cover 22 is coupled to the body 14 and can be selectively opened (as shown in FIGS. 1 and 2) for using the binding machine 10, or closed to conceal the working deck 18.

A punching mechanism is housed within the body 14 to punch sheets to be bound. A slot or aperture 26 (see FIG. 2) in the working deck 18 receives sheets to be punched. A selection lever 30 is moved by the user to provide a left edge guide for proper placement and centering of the sheets within the slot 26 for punching depending on the size of the sheets (e.g., letter size, over size, A4 size, etc.). The punching mechanism is actuated by a lever or handle 34. The user pulls the lever 34 to drive the punch elements, sometimes referred to as teeth, through the sheets in the slot 26. If the stack of sheets to be punched is too thick to be placed in the slot 26 at one time, the user can divide the stack and perform multiple punching operations until all of the sheets to be bound have been punched. In other embodiments, an automatic, push-button actuated punching mechanism can replace the manual, lever-operated punching mechanism.

Figure 3:
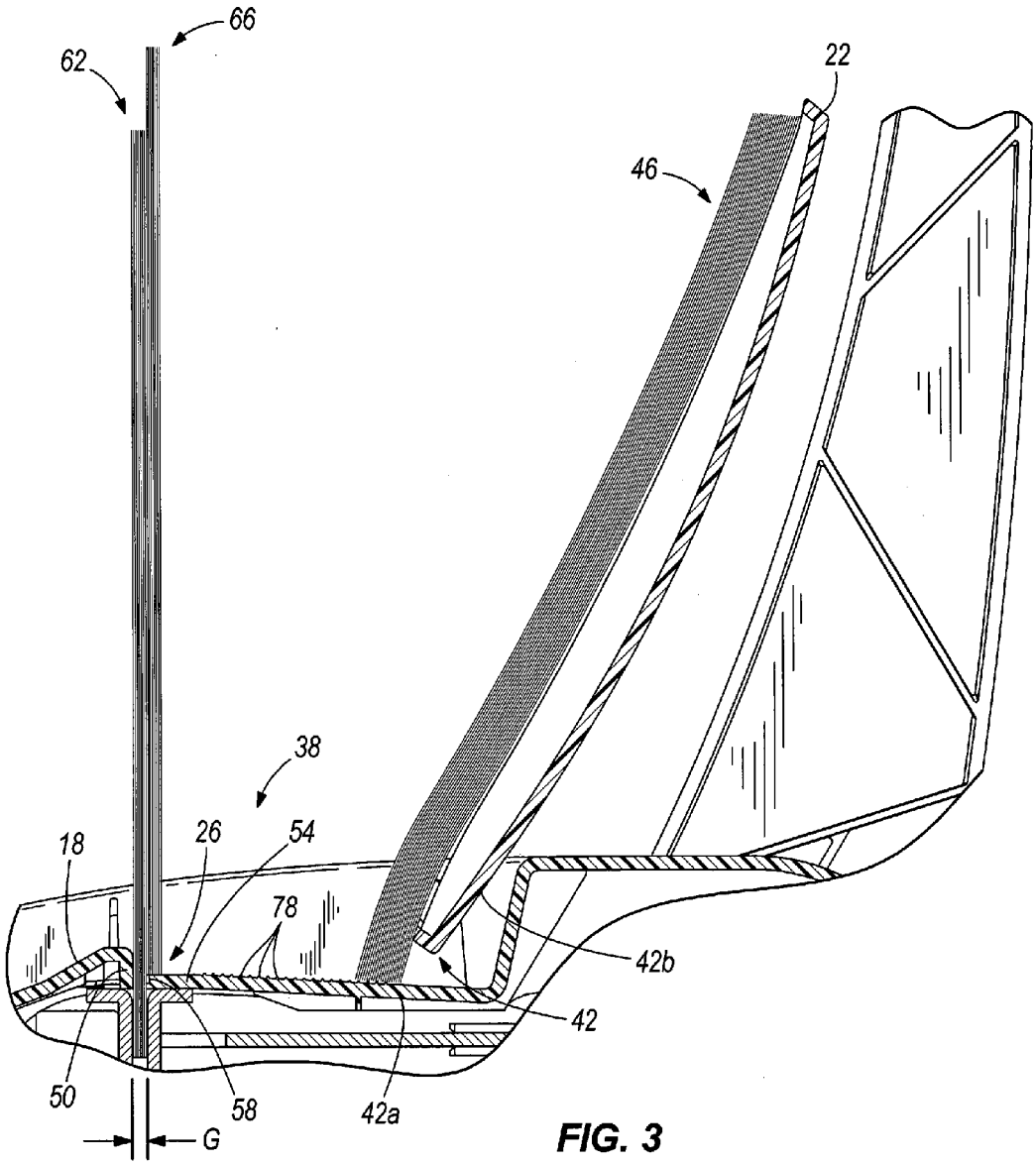
FIG. 3 is a partial section view of the binding machine taken through line 3-3 of FIG. 2.

FIG. 3 illustrates a sheet dividing arrangement or construction 38 operable to assist a user in dividing a stack of sheets for punching. The illustrated sheet dividing arrangement 38 is positioned or integrally formed on the working deck 18 adjacent the slot 26, but can alternatively be a separate fixture spaced from the slot 26 that can be connected to the body 14 or free-standing and separate from the binding machine 10. The sheet dividing arrangement 38 includes a sheet support shelf 42 that can include a base portion 42*a* and a wall portion 42*b* cooperative to support an entire stack of sheets 46 to be bound. In the illustrated embodiment, the base portion 42*a* is formed by the working deck 18 and the wall portion 42*b* is formed by the cover 22. The user can utilize the sheet support shelf 42 to align all of the sheets 46 in preparation for dividing and punching.

With the stack of sheets 46 aligned and ready for punching, the user grasps and moves the stack of sheets (to the left in FIG. 3) such that the stack abuts a generally vertical alignment wall 50 of the sheet dividing arrangement 38. The alignment wall 50 is formed by one side of the slot 26 and the working deck 18. A generally horizontal separating wall 54 formed by the working deck 18 is spaced from the alignment wall 50 such that a gap G is defined between the alignment wall 50 and a distal end 58 of the separating wall 54. The gap G defines the width of the slot 26. In some embodiments, an angled wall portion can extend downwardly from the distal end 58 and at an angle away from the alignment wall 50 to provide a shearing force, acting opposite gravity, to help separate the sheets and reduce friction between the distal end 58 and the sheets. The gap G is sized to allow a portion of the sheets 62 to enter the gap G or slot 26, that portion 62 being the maximum thickness of sheets corresponding to the maximum capacity of the punching mechanism. The user can relax his grasp on the stack of sheets 46 thereby allowing the portion of sheets 62 to fall under the force of gravity into the gap G. The remaining portion of the sheets 66 not fitting in the gap G remains supported on the separating wall 54, and can then be placed by the user back in the sheet support shelf 42 until later.

With the appropriate thickness of sheets in the portion of sheets 62, the user can then punch the portion of sheets 62 in the punching mechanism. The sheet dividing arrangement 38 is positioned on the working deck 18 such that the gap G defines the slot 26. The sheets can be guided or positioned at their left edge using the selection lever 30, and then the lever 34 can be pulled for punching. The punched sheets can then be removed from the slot 26 and set aside or placed directly onto an open binding element, as described below. The user can then grasp the remaining portion of sheets 66 from the sheet support shelf 42 and divide them (if necessary) by repeating the same steps described above.

Those skilled in the art will understand that the sheet dividing arrangement 38 need not include the optional sheet support shelf 42, but is operable with just the two features defining the gap G (i.e., the alignment wall 50 and the separating wall 54). The sheet dividing arrangement 38 eliminates the need for a user to count the number of sheets, measure the thickness of the sheets, or to use more complex and less intuitive internal or external devices for determining how many sheets can be punched at one time. The sheet dividing arrangement 38 intuitively and easily allows the user to properly divide the stack of sheets 46 to complete the punching operation in as few punch strokes as possible. The construction and geometry of the sheet dividing arrangement 38 also makes it easier for the user to maintain alignment and pagination of the sheets while manipulating the sheets during the punching operation. The sheet dividing arrangement 38 can also be a mechanized device that automatically feeds and divides a stack of sheets using some or all of the parts described herein with some modification.

Figure 4:
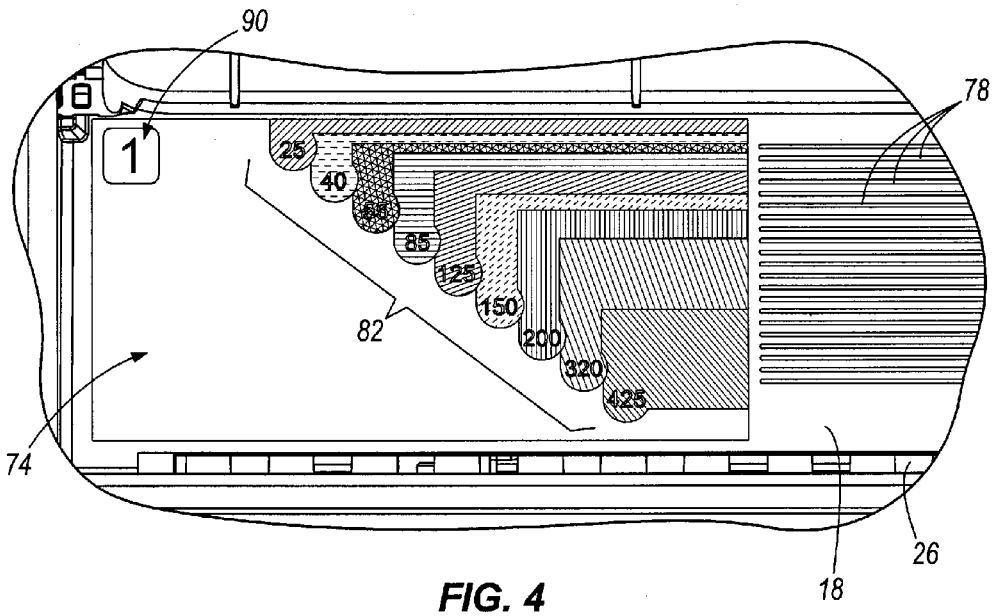
FIG. 4 is an enlarged view of a binding element selection portion of the binding machine of FIG. 1.
Figure 6:
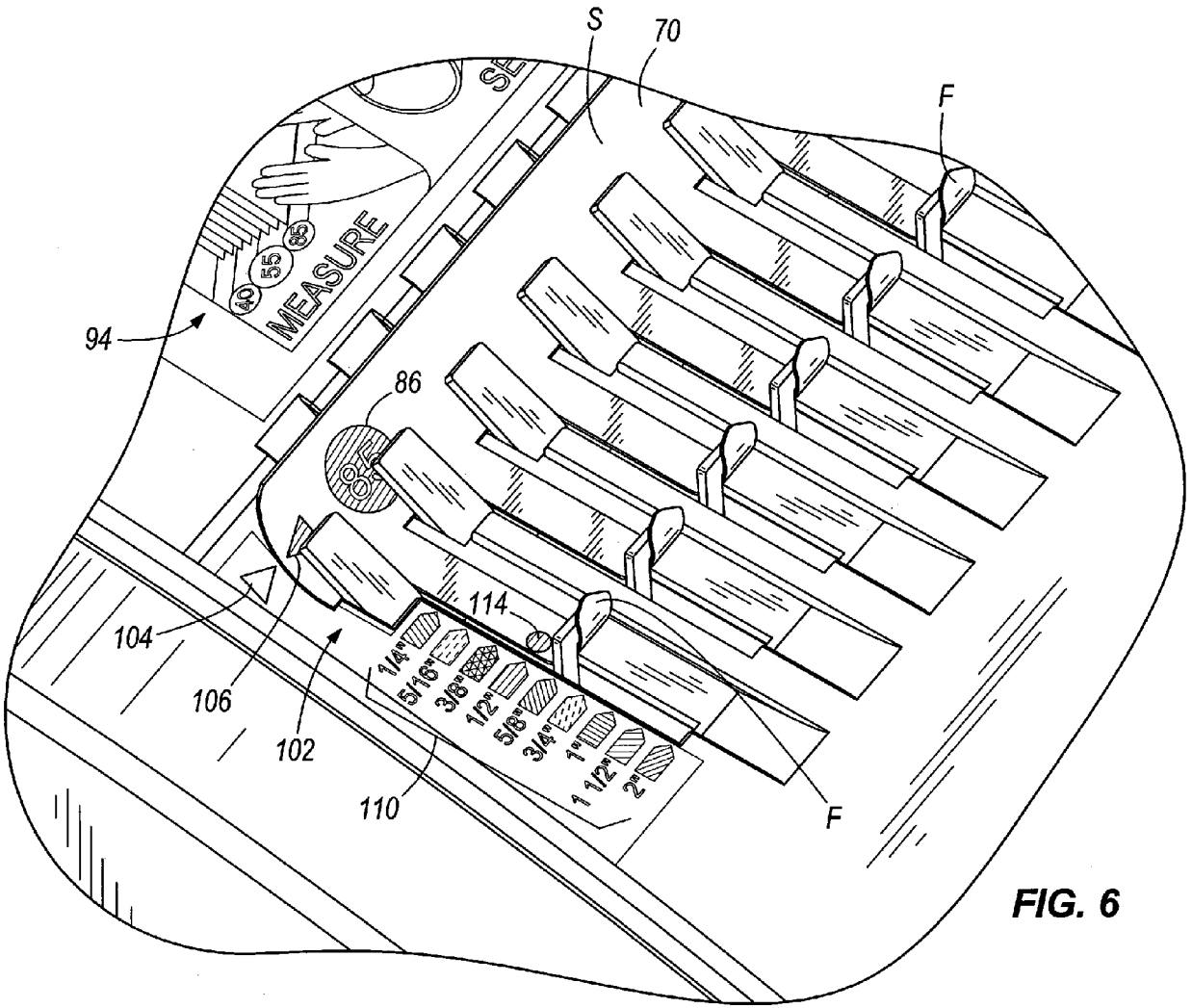
FIG. 6 is an enlarged view of a binding element loading portion of the binding machine of FIG. 1, shown with a binding element supported thereon.

The binding machine 10 and the binding elements 70 operate as a system with several features to make the binding operation more intuitive and user-friendly. Specifically, the binding machine 10 and the binding elements 70 are coordinated to define a user-friendly binding system. Referring to FIGS. 4 and 6, the working deck 18 includes portions or sections designed to assist the user with operations to be performed in binding a stack of sheets, such as (1) selecting the proper binding element 70; (2) orienting the binding element 70 with respect to the binding machine 10; and (3) opening the binding element 70 to the optimum sheet loading position or orientation.

Referring to FIGS. 1, 2, and 4, the working deck 18 includes a binding element or comb selection portion 74 including indicia to assist the user in determining the size of the binding element or comb 70 to be used with the particular stack of sheets to be bound. The stack of sheets can be positioned over the lines or ribs 78 with the front sheet abutting the cover 22 or other structure on the working deck 18, and the color coding or thickness selection indicia 82 adjacent the lines indicates to the user approximately how many sheets are in the stack. For example, and as best seen in FIG. 4, the thickness selection indicia 82 is divided into different color segments or bands, each including a different colored circle with a number to indicate the approximate number of sheets in the stack based on standard sheet thicknesses. In the illustrated embodiment, the twenty-five sheet band is green, the forty sheet band is yellow, the fifty-five sheet band is orange, the eighty-five sheet band is red, the 125 sheet band is pink, the 150 sheet band is light purple, the 200 sheet band is dark purple, the 320 sheet band is dark blue, and the 425 sheet band is light blue. Of course, other color combinations and band/number configurations can be substituted for those illustrated. FIGS. 1 and 2 illustrate the placement of another indicia 84, similar to the thickness selection indicia 82, on the underside of the cover 22 for user reference. The indicia 84 has the colored number identifiers matching those of the indicia 82, and also indicates the approximate stack thickness (e.g., in inches).

Figure 5:
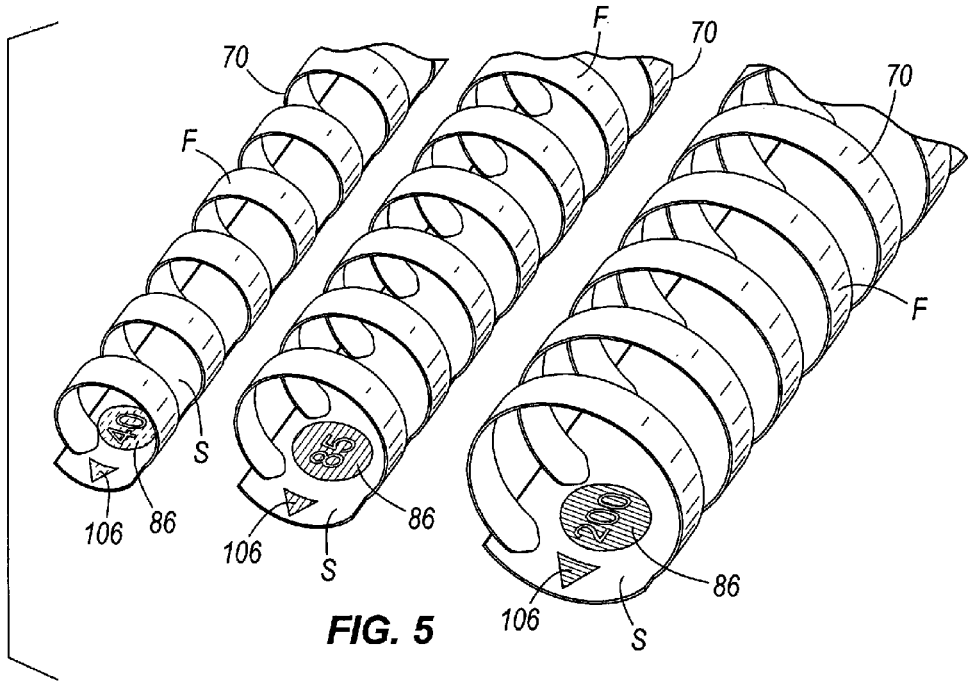
FIG. 5 is a perspective view showing a plurality of binding elements embodying the invention.

Once the user determines the color and/or number from the different options of the thickness selection indicia 82 corresponding with the particular sheet stack thickness, he selects the corresponding binding element 70. As shown in FIGS. 4 and 5, the binding elements 70 and the binding machine 10 define a system of indicia or color coding that assists the user. FIG. 5 illustrates three binding elements 70 of different sizes. Each binding element 70 includes a colored number circle representing a thickness selection indicia 86 corresponding to one of the color coding bands/circles and numbers from the thickness selection indicia 82 on the binding machine 10. The indicia 86 is positioned on an interior surface of the spine S of the binding element 70 for easy viewing during the selection and binding process. Once the stack of sheets is bound, the indicia 86 can be largely hidden by the sheets. The user selects the binding element 70 having the matching color and/or number indicia 86 to the thickness selection indicia 82 for the measured stack of sheets to be bound. The binding elements 70 are sized to properly bind the particular number of sheets indicated by the indicia 86. The indicia 86 on the binding element can also provide a branding function, helpful in alerting the user to the brand of binding element 70 and the brand of the associated binding machine 10. When additional binding elements 70 are needed, the user knows what brand of binding elements should be purchased in order to maximize the functionality of the binding machine 10.

Figure 7:
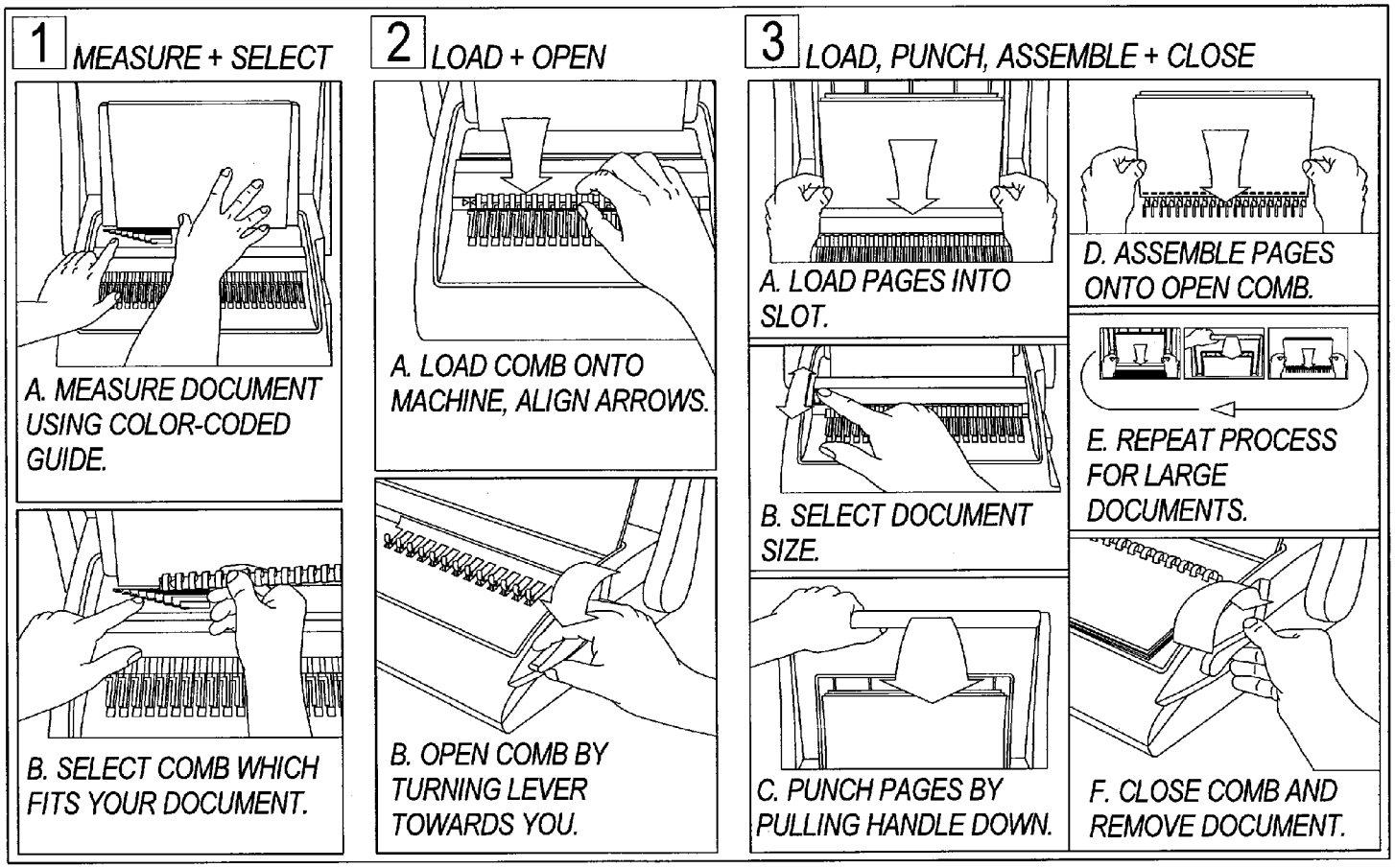
FIG. 7 is an image of an instructional sequence for the binding system embodying the invention.

The illustrated comb selection portion 74 also includes an indicia 90 in the form of a number (e.g., 1) that can assist a user in understanding and performing the operational steps to be performed with the binding machine 10. This indicia 90 coordinates with a matching number provided on an instructional bar 94 provided on the working deck 18 (see FIG. 2), and can also coordinate with text and/or images 98 (see FIG. 7) printed in the instruction manual and/or on an operational reference guide for the binding machine 10. Such a reference guide could, for example, be affixed to the underside of the cover 22 for easy reference by the user. In the illustrated embodiment, the number 1 is used for the indicia 90 and directs the user to the matching number 1 indicia on the instructional bar 94 and the text 98 indicating that this is for the "MEASURE" and "SELECT" steps. The text 98 associated with MEASURE reads "A. Measure document using color-coded guide.", and the text 98 associated with SELECT reads "B. Select comb which fits your document.", thereby instructing the user on how to use the comb selection portion 74.

Referring to FIG. 6, the working deck 18 further includes a binding element loading portion 102 where the selected binding element 70 is positioned and oriented on the binding machine 10 to receive the punched sheets for binding. To ensure that the user correctly orients the binding element 70 in the binding element loading portion 102, the binding machine 10 and the binding elements 70 include alignment indicia 104, 106, respectively. In the illustrated embodiment, the alignment indicia 104 takes the form of an arrow or triangle on the working deck 18, and the alignment indicia 106 takes the form of a corresponding arrow or triangle on the binding element 70. The arrows 104, 106 are to be aligned as shown to prevent the user from putting the binding element 70 in the loading portion 102 in the improper manner (i.e., the binding element 70 being rotated 180 degrees improperly). In the illustrated embodiment, the arrow 106 on the binding elements 70 is of the same color as the indicia 86. The arrow 104 on the binding machine 110 is white, but can also be other colors, preferably however, not a color used for other indicia on the machine 10. Furthermore, while the arrow 106 on the binding element 70 is shown positioned on an interior surface of the spine S, it could alternatively, or additionally also be positioned on a finger F, with a corresponding arrow 104 positioned in alignment elsewhere on the working deck 18 or on the binding machine 10.

The binding element loading portion 102 further includes color coded binding element opening indicia 110 operable to assist the user with how far the binding element fingers F are to be opened for optimal loading characteristics of the stack of sheets onto the binding element 70. As seen in FIG. 6, the color coded opening indicia 110 includes a plurality of colored segments or marks that extend from adjacent the spine S of the binding element 70, outwardly in the direction of extension of the opened binding element fingers F or ring elements. As illustrated, the colored segments of the opening indicia 110 follow the same color coding sequence as the thickness selection indicia 82 (e.g., green, yellow, orange red, pink, light purple, dark purple, dark blue, light blue in a direction from nearest to the binding element spine S to farthest away from the binding element spine S). The opening indicia 110 can also indicate the approximate stack thickness (e.g., in inches) as shown. Each binding element 70 includes a binding element opening indicia 114 on at least one finger F or ring element (e.g., on an interior surface of the first finger F) that is color coded to the binding element 70 (i.e., is the same color as the indicia 86 and 106) and is spaced from the spine S of the binding element when the finger F is extended or opened such that it will align with the corresponding segment of the opening indicia 110. In the illustrated embodiment shown in FIG. 6, the binding element 70 with the red, number eighty-five indicia is shown with the fingers F opened revealing the red dot or mark opening indicia 114 on the first finger F aligned with the corresponding red segment of the opening indicia 110. To properly open the binding element 70, the user operates the handle 118 to open the fingers F of the binding element 70 until he can see the appropriate opening indicia 114 on the binding element 70 aligned with the corresponding segment of the opening indicia 110 on the working deck 18. Once this alignment is achieved, the binding element 70 is optimally opened for receipt of the punched stack of sheets.

The binding element loading portion 102 also includes an indicia 122 (see FIGS. 1 and 2) in the form of a number (e.g., 2) that can assist the user in understanding and performing the operational steps to be performed with the loading portion 102. This indicia 122 also coordinates with a matching number provided on the instructional bar 94 (see FIG. 2), and can also coordinate with the text 98 (see FIG. 7) printed in the instruction manual and/or on the operational reference guide for the binding machine 10. In the illustrated embodiment, the number 2 is used for the indicia 122 and directs the user to the matching number 2 indicia on the instructional bar 94 and the text 98 indicating that this is for the "LOAD" and "OPEN" steps. The text 98 associated with LOAD reads "A. Load comb onto machine, align arrows.", and the text 98 associated with OPEN reads "B. Open comb by turning lever towards you.", thereby instructing the user on how to use the binding element loading portion 102.

As best shown in FIG. 2, the slot 26 and selection lever 30 are provided in a punching portion 126 of the working deck 18, which can include the indicia 130 in the form of a number (e.g., 3) that can assist the user in understanding and performing the operational steps to be performed with the punching portion 126. This indicia 130 also coordinates with a matching number provided on the instructional bar 94, and can also coordinate with the text 98 (see FIG. 7) printed in the instruction manual and/or on the operational reference guide for the binding machine 10. In the illustrated embodiment, the number 3 is used for the indicia 130 and directs the user to the matching number 3 indicia on the instructional bar 94 and the text 98 indicating that this is for the "LOAD", "PUNCH", "COMBINE", "REPEAT", and "CLOSE" steps. The text 98 associated with LOAD reads "A. Load pages into slot." and "B. Select document size.", the text 98 associated with PUNCH reads "C. Punch pages by pulling handle down", the text 98 associated with COMBINE reads "D. Assemble pages onto open comb.", the text 98 associated with REPEAT reads "E. Repeat process for large documents.", and the text 98 associated with CLOSE reads "F. Close comb and remove document", thereby instructing the user on how to use the punching portion 126 and the loading portion 102 to complete the binding operation.

One skilled in the art will understand that the illustrated indicia, color coding schemes, and the like are shown by way of example only, and that different indicia and color coding schemes can be substituted as desired to achieve the same or similar functionality. For example, numbers used in indicia can be replaced with letters or other types of indicia. Color schemes can vary from those illustrated, or can be replaced with geometric or other matching schemes. Furthermore, the particular use and shapes of geometric figures, such as arrows and particularly-shaped colored segments and identifiers, can also vary. The various indicia can be provided on the binding machine 10 and the binding elements 70 using any suitable methods, including printing, embossing, De-bossing, punching, surface texturing, and molding. With regard to the indicia on the binding elements, it is preferable to make the indicia forming process "in-line" with the element forming process so as not to add extra steps or stations that might add to the manufacturing costs. For example, in-line printing heads can be added to the punching press or spine/comb rolling area of the binding element manufacturing process.

Various features of the invention are set forth in the following claims.

The invention claimed is:

1. A binding system for binding a stack of sheets with a binding element, the binding system comprising:

a binding machine having a binding element selection portion for measuring a stack of sheets to be bound, the binding element selection portion including a plurality of different thickness selection indicia for associating with different thicknesses of the stack of sheets, a selected one of the plurality of thickness selection indicia corresponding with the thickness of the stack of sheets to be bound; and a binding element loading portion for supporting a binding element in position for loading the stack of sheets thereon, the binding element loading portion including an alignment indicia and a plurality of different binding element opening indicia; and binding elements of different sizes for binding stacks of sheets of varying thicknesses, each size of binding element having thereon a thickness selection indicia corresponding to one of the plurality of thickness selection indicia on the binding machine such that a binding element having the thickness selection indicia corresponding to the selected thickness selection indicia can be used for binding the stack of sheets;

each binding element further including an alignment indicia corresponding with the alignment indicia on the binding machine such that alignment of the alignment indicia on the binding element with the alignment indicia on the binding machine indicates a correct orientation of the binding element in the binding element loading portion; and each binding element further including a finger having a binding element opening indicia thereon corresponding to one of the plurality of different binding element opening indicia on the binding machine such that alignment of the binding element opening indicia on the finger of the binding element with the corresponding binding element opening indicia on the binding machine indicates an optimal opened position of the binding element for loading the stack of sheets thereon.

2. The binding system of claim 1, wherein the alignment indicia on the binding machine and the alignment indicia on the binding element include corresponding shapes.

3. The binding system of claim 1, wherein the thickness selection indicia on the binding machine and the thickness selection indicia on the binding element include corresponding colors.

4. The binding system of claim 1, wherein the thickness selection indicia on the binding machine and the thickness selection indicia on the binding element include corresponding numbers.

5. The binding system of claim 1, wherein the thickness selection indicia on the binding element is on an interior surface of the binding element.

6. The binding system of claim 1, wherein the binding element opening indicia on the binding machine include a plurality of different colors, and wherein the binding element opening indicia on the binding elements include corresponding colors.

7. The binding system of claim 1, wherein the thickness selection indicia on the binding machine include a plurality of different numbers, and wherein the thickness selection indicia on the binding elements include corresponding numbers, the numbers being generally indicative of a number of sheets in the stack of sheets.

8. The binding system of claim 1, wherein each of the binding elements has a spine, and wherein the thickness selection indicia on the binding elements is on the spine.

9. The binding system of claim 8, wherein the thickness selection indicia on the binding elements is on an interior surface of the spine.

10. The binding system of claim 1, wherein the binding element opening indicia on each binding element is on an interior surface of the finger.

11. The binding system of claim 1, wherein the binding element opening indicia on the finger includes a colored mark, and wherein the plurality of different binding element opening indicia on the binding machine includes a plurality of different colored indicia, one of the colored indicia corresponding to the colored mark such that alignment of the colored mark with the corresponding colored indicia on the binding machine indicates the optimal opened position of the binding element for loading the stack of sheets thereon.

12. The binding system of claim 1, wherein the alignment indicia on the binding machine and the corresponding alignment indicia on the binding element are arrows.

13. The binding system of claim 1, wherein each of the binding elements includes a spine and a plurality of fingers coupled with the spine for forming a respective plurality of ring elements operable to retain the stack of sheets.

* * * * *